US011629463B2

(12) United States Patent
Menzenbach et al.

(10) Patent No.: US 11,629,463 B2
(45) Date of Patent: *Apr. 18, 2023

(54) MACHINE TRAIN COMPOSED OF ROAD MILLING MACHINE AND ROAD FINISHER, AND METHOD FOR OPERATING ROAD MILLING MACHINE AND ROAD FINISHER

(71) Applicant: Wirtgen GmbH, Windhagen (DE)

(72) Inventors: Christoph Menzenbach, Neustadt (DE); René Müller, Vettelschoß (DE); Cyrus Barimani, Königswinter (DE)

(73) Assignee: Wirtgen GmbH

( * ) Notice: Subject to any disclaimer, the term of this patent is extended or adjusted under 35 U.S.C. 154(b) by 0 days.

This patent is subject to a terminal disclaimer.

(21) Appl. No.: 17/539,395

(22) Filed: Dec. 1, 2021

(65) Prior Publication Data

US 2022/0145552 A1 May 12, 2022

Related U.S. Application Data

(63) Continuation of application No. 15/987,958, filed on May 24, 2018, now Pat. No. 11,193,245.

(30) Foreign Application Priority Data

May 26, 2017 (DE) ..... 10 2017 005 015.5

(51) Int. Cl.
*E01C 23/088* (2006.01)
*E01C 19/48* (2006.01)
*E01C 19/00* (2006.01)

(52) U.S. Cl.
CPC ..... *E01C 23/088* (2013.01); *E01C 19/004* (2013.01); *E01C 19/006* (2013.01); *E01C 19/48* (2013.01)

(58) Field of Classification Search
None
See application file for complete search history.

(56) References Cited

U.S. PATENT DOCUMENTS 5,258,961 A 11/1993 Sehr et al.
5,309,407 A 5/1994 Sehr et al.
(Continued)

FOREIGN PATENT DOCUMENTS

CN 101466899 A 6/2009
DE 102006020293 A1 11/2007
(Continued)

OTHER PUBLICATIONS

China Office Action for corresponding CN 108930218 dated Mar. 26, 2020, 4 pages (not prior art).
(Continued)

*Primary Examiner* — Yuen Wong
*Assistant Examiner* — Hongye Liang
(74) *Attorney, Agent, or Firm* — Gary L. Montle; Lucian Wayne Beavers; Patterson Intellectual Property Law, PC

(57) ABSTRACT

A machine train is composed of a road milling machine that travels in front and a road finisher that travels behind. The road milling machine has a profile data determining device configured so that a sequence of height profile data describing the height of the road surface in the longitudinal direction is determined while the road milling machine advances. For transmission of the height profile data, a data transmission device is provided on the road milling machine and a data receiving device is provided on the road finisher. To change the position of the screed, the road finisher has a levelling device that comprises at least one actuator and a control unit, which is configured so that the control unit generates a control signal for controlling the at least one actuator in accordance with a height profile data set.

17 Claims, 3 Drawing Sheets

(56) References Cited

U.S. PATENT DOCUMENTS

| | | | | |
|---|---|---|---|---|
| 5,401,115 | A * | 3/1995 | Musil | E01C 19/008 404/75 |
| 7,946,787 | B2 * | 5/2011 | Glee | E01C 19/004 404/75 |
| 7,946,788 | B2 | 5/2011 | Jurasz et al. | |
| 8,424,972 | B2 | 4/2013 | Berning et al. | |
| 9,121,145 | B2 | 9/2015 | Berning et al. | |
| 9,879,386 | B2 * | 1/2018 | Marsolek | G06Q 50/08 |
| 10,024,708 | B2 | 7/2018 | Marsolek et al. | |
| 2002/0047301 | A1 * | 4/2002 | Davis | E01C 19/006 299/1.5 |
| 2009/0108663 | A1 | 4/2009 | Berning et al. | |
| 2009/0317186 | A1 | 12/2009 | Glee et al. | |
| 2012/0263532 | A1 * | 10/2012 | Rutz | E01C 19/00 404/75 |

FOREIGN PATENT DOCUMENTS

| | | | |
|---|---|---|---|
| DE | 102016006006 | A1 | 11/2016 |
| EP | 542297 | A1 | 5/1993 |
| EP | 547378 | A1 | 6/1993 |
| EP | 1959056 | A2 | 8/2008 |
| WO | 2017100312 | A1 | 6/2017 |

OTHER PUBLICATIONS

European Search Report on corresponding EP 18 173 127.4, dated Oct. 5, 2018, 9 pages (not prior art).
Concise Description of Relevance and Third Party Submission filed in U.S. Appl. No. 15/987,958 (not prior art)(35 pages).
"Truncated Mean—Wikipedia, 2013" (Year: 2013).

* cited by examiner

MACHINE TRAIN COMPOSED OF ROAD MILLING MACHINE AND ROAD FINISHER, AND METHOD FOR OPERATING ROAD MILLING MACHINE AND ROAD FINISHER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of German Patent Application No. 10 2017 005 015.5, filed May 26, 2017, and which is hereby incorporated by reference.

BACKGROUND

The invention relates to a machine train composed of a road milling machine that travels in front and comprises a machine frame supported by crawler tracks or wheels and a milling drum arranged on the machine frame that is for milling away material, and to a road finisher that travels behind and comprises a machine frame which is supported by crawler tracks or wheels and on which a reservoir for material to be laid and a screed for laying material are arranged. The invention also relates to a method for operating a road milling machine and a road finisher.

In road construction, self-propelled construction machines having different designs are used. These machines include the known road milling machines, by means of which existing road layers of the road pavement can be removed. The aforementioned road milling machines have a rotating milling drum which is equipped with suitable milling or cutting tools for machining the ground. The milling drum is arranged on the machine frame, the height of which can be adjusted with respect to the ground to be machined. The height of the machine frame is adjusted by means of a lifting device, which has lifting columns associated with the individual crawler tracks or wheels. To remove the material that has been milled away, the road milling machine has a conveying device with a conveyor belt. Further, the known road milling machines have a control and processing unit, with which the lifting device is controlled. To mill a damaged road surface, the machine frame is lowered so that the milling drum penetrates into the road surface. The lifting columns then make it possible both to adjust the height of the machine frame or milling drum and to set a predetermined incline of the milling drum transversely to the direction of advance of the road milling machine.

To precisely set the milling depth and milling incline, the known road milling machines have milling depth control devices or levelling systems that have one or more measurement devices for measuring the distance between a reference point on the milling machine and the road surface to be processed. In order to measure the distance, the known measurement devices have tactile sensors or non-touch sensors, for example, ultrasonic sensors. Elongated areas of unevenness are measured with the use of measurement systems called multiplex levelling systems, which have a plurality of distance sensors that are arranged at a distance from one another in the longitudinal direction of the ground to be machined, in order to be able to calculate an average value from the measurement values of the individual sensors. The lifting columns are then controlled in accordance with the average value so that smaller uneven areas can be largely levelled out. In the known multiplex systems, the distance sensors are fastened to a long jib that is attached to one side of the machine frame.

The road material is laid with the use of road finishers, which have a reservoir for containing the mix as well as a screed. The mix is conveyed with a conveying device from the reservoir to the screed, wherein the mix is piled up in front of the screed in the direction of finishing. There are known screeds that float on the material to be laid. This makes it possible to largely level out smaller uneven areas on the ground. The screed generally has a device for heating and compacting the material to be laid. The road finishers may, like the road milling machines, have a levelling device that may have one or more distance sensors.

In specific paving situations, it may be necessary to change the floating behavior of the screed. Known road finishers are therefore provided with a floating mounting of the screed that makes it possible to raise and lower the screed, it also being possible to change the transverse incline of the screed. The position of the screed is altered or adjusted with a levelling device in relation to a reference line or reference surface.

Generally, the material that has been milled away by the road milling machine from the construction site is removed by truck in order for it to be able to be conditioned in a conditioning installation. Conditioned mix is then driven by truck to the construction site in order to be laid again with the road finisher. A road milling machine may, however, also be operated together with a road finisher as a machine train. The road milling machine, which travels in front, is then used as a recycler that mills away the damaged road surface and conditions the milled-off layer with, for example, additive materials such as a bitumen emulsion, while the road finisher, which travels behind, lays the conditioned layer back. Then, the conveying device of the road milling machine conveys the milled-off material into the reservoir of the road finisher.

If a road finisher is operated together with a road milling machine as a machine train, then only a certain amount of material is available. While the two road construction machines advance, the road finisher can only lay as much material as the road milling machine has previously milled off. It should then be noted that the volume of material that is milled off per unit time or per section with the road milling machine may vary constantly depending on the nature of the road surface. The volume of the material to be laid with the road finisher per unit time or section, too, is not constant. For example, levelling off a depression necessitates a greater volume of material for the corresponding section. Consequently, the location of the screed needs to be changed in order to achieve a smooth road surface. Proper operation of the road finisher also requires a sufficient amount of material in the reservoir.

DE 10 2006 020 293 A1 discloses a levelling device for a road milling machine that is provided, on the left and right sides of the road milling machine, with a sensor for detecting the actual value of the milling depth and a sensor for detecting the current incline of the milling drum in relation to a reference surface, respectively. The milling depth on the left and right sides of the machine may be predetermined in accordance with the deviation of the target values from the measured actual values. The milling depth may also, however, be predetermined on only one of the two sides. In this case, a certain transverse incline may be predetermined on only one side, in addition to the milling depth.

EP 0 542 378 B1 describes a control device for a road milling machine that comprises three ultrasonic sensors that are arranged one behind the other in the direction of advance of the milling machine. A shoulder of the road is to be scanned with the ultrasonic sensors, as a reference surface. Two distance sensors are arranged on the machine frame at the height of the tracks, and one sensor is arranged between the tracks. The distance values are assessed statistically, for example an average value is formed, in order to generate a control signal for the lifting device in order to adjust the height of the tracks.

EP 0 542 297 B1 proposes an ultrasonic control unit for a road finisher that comprises three ultrasonic sensors that are arranged one behind the other in the direction of advance of the finisher and are fastened to a mount. The measured distance values are assessed in order to generate a control signal for a levelling device in order to change the position of the screed. Any distance values lying outside predetermined limits are to be discarded. Uneven parts of the sampled reference plane are to be largely offset by taking an average value. A disadvantage is that the distance values can only be measured over a region that is determined by the sensors attached to the mount. Therefore, elongated uneven areas that extend over a greater length than the machine frame cannot be detected.

The invention addresses the problem of achieving improved detection of the ground in order to also to be able to detect elongated uneven areas. The invention also addresses the problem of scanning a reference surface or line with relatively little additional technical expenditure for the operation of the road finisher.

BRIEF SUMMARY

These problems are solved according to the invention by the features of the independent claims. The dependent claims relate to advantageous embodiments of the invention.

The invention makes use of the fact that the road finisher, which comprises a machine frame which is supported by crawler tracks or wheels and on which a receptacle for material to be laid and a screed for laying material are arranged, is operated preferably in combination with a road milling machine that has a machine frame supported by crawler tracks or wheels and a milling drum that is arranged on the machine frame and is for milling off material. In principle, rather than operating the road milling machine and road finisher as a machine train, it is also possible to use the road milling machine in a first work step and the road finisher in a second work step, wherein the first and second work steps need not immediately follow one another. For example, there may be one or more hours or days between the two work steps.

The machine train composed of the road milling machine that travels in front and the road finisher that travels behind is characterized in that the road milling machine comprises a profile data determining device for the levelling device of the road finisher, wherein the profile data determining device is configured so that a sequence of height profile data describing the height of the road surface in the longitudinal direction is determined while the road milling machine advances. The reference line or reference surface, for example a strip of the road surface to be machined, is thus not scanned with distance sensors—which may be located on the road finisher only within a region delimited by the geometric dimensions of the machine frame—but rather by means of the advancing road milling machine. Consequently, the road milling machine serves as a "scanning device".

In this context, "height profile data" is understood to mean any and all data with which the profile of any strip or line extending in the longitudinal direction of the road surface to be machined can be described, for example the distance values between an assumed reference point or a reference line, for example the mean profile in the middle of the road, and another reference point or a reference line on the road surface. "Profile data" is also understood to mean corresponding electrical signals. The height profile data may comprise absolute or relative distance values.

To transmit the height profile data, a data transmission device is provided on the road milling machine. In this context, a data transmission device is understood to mean any and all means with which data or signals can be transmitted. The data may be transmitted, for example, with electromagnetic or optical signals.

In the simplest case, the data transmission device may be an indicator unit on which the height profile data or data derived therefrom is indicated so that the machine driver of the road finisher or another person can see the height profile data. The data derived from the height profile data may be visualized on the indication unit, for example, as symbols or the like that can be used as work instructions for controlling the finisher. The road finisher, however, preferably comprises a data receiving device so that the height profile data can be received by the road finisher.

The data transmission device and data receiving device may be a transmitting and receiving device that may comprise a radio transmitter and receiver, and may be, for example, part of a wireless local area network (WLAN). The data transmission device may also comprise a device for reading out data onto a data carrier, for example, a drive or a USB stick, and the data receiving device may comprise a device for reading data from a data carrier. The data then needs to be buffered on a data carrier if, rather than the road milling machine and the road finisher being operated as a machine train, a certain length of time passes between the work step of recording and reading the data.

To change the position of the screed, the road finisher has a levelling device that comprises at least one actuator and a controller, which is configured so that the controller generates a control signal for controlling the at least one actuator in accordance with a height profile data set that is obtained from the height profile data determined by the road milling machine.

Consequently, the height profile data can be recorded in advance over a wide range of the road surface with the road milling machine, before the material is laid in this area with the road finisher. For the period of time that the road finisher requires in order to cover the relevant section, the height profile data may be buffered in a memory. This memory may be provided on the road milling machine or on the road finisher.

Obtaining the height profile data set from the height profile data requires assessing the data or signals. Because the invention lies first and foremost in the provision of the data, the matter of how the data is processed or assessed and how the position of the screed is controlled with this data is not decisive for the invention. For example, the acquired height profile data or data derived therefrom may be represented solely on an indicator on the basis of which the machine operator of the road finisher executes manual control of the position of the screed.

The height profile data set may be obtained from the height profile data with an assessment device that may be provided in the road milling machine or in the road finisher. Preferably, the assessment device is a component of a control and processing unit of the road milling machine.

A preferred embodiment provides that the assessment device is configured so that the height profile data is assessed statistically in order to obtain the height profile data set. The assessment device is preferably configured so that the statistical assessment of the height profile data comprises taking an average value and/or discarding height profile data lying outside predetermined boundary ranges.

Another preferred embodiment provides that the road milling machine comprises a device for determining spatial data, wherein the profile data determining device is configured so that spatial height profile data is obtained from the height profile data. The device for determining spatial data may be, in the simplest case, for example, an odometer. The position in space may also, however, be determined with a global positioning system (Global Navigation Satellite System (GNSS), e.g. GPS). With the additional spatial data, the height profile for any point in space can be described.

The tracks or wheels of the road milling machine are fastened via lifting columns to the machine frame in such a manner that the height of the machine frame relative to the surface of the ground can be changed in order to adjust the milling depth of the milling drum.

Suitable height profile data for controlling the screed is acquired in an especially easy and reliable manner with the road milling machine travelling in front if it can be assumed that changes to the height profile are to be expected only on one side, i.e. on the left or right side of the machine as seen in the direction of travel. This situation often arises when roads are being repaired because the surface of a road in need of repair has little to no unevenness in the middle of the road, whereas the road surface often does have significantly uneven areas at the edges of the road, for example due to subsidence in the curb region. In processing with road milling with a milling width of, for example, about two meters, a track is removed in each operation, wherein one machine side moves on the barely-worn middle of the road, and the other machine side moves over the edge of the road with relatively significant uneven areas.

In this case, height profile data suitable for controlling the screed can be acquired in an especially easy and reliable manner with the road milling machine travelling in front if the road milling machine comprises a transverse incline sensor that generates a sequence of transverse incline data in accordance with the transverse incline of the machine frame and/or the milling drum, wherein the profile data determining device is configured so that the height profile data is obtained from the transverse incline data determined with the transverse incline sensor. It is assumed then that the transverse incline of the road milling machine describes the height profile of the road surface on one side of the road in the longitudinal direction. This is the case if the road milling machine comprises a milling depth control device that is for controlling the lifting columns and comprises a first measurement device for measuring the distance of a reference point on the road milling machine to the surface of the unprocessed ground on the left side of the milling drum as seen in the working direction, and a second measurement device for measuring the distance of a reference point on the road milling machine to the surface of the unprocessed ground on the right side of the milling drum as seen in the working direction, wherein the milling depth control device is configured so that the lifting columns are controlled such that when the road milling machine advances, the milling depth on the left and right side of the milling drum as seen in the working direction is kept substantially constant, regardless of the condition of the ground surface. This milling depth control leads to removal of a predetermined layer thickness regardless of the condition of the ground, over the entire width of the milling drum or roadway. As a consequence, the transverse incline of the machine frame and the milling drum on the machine frame can change when the road milling machine advances in a manner corresponding to the profile of the road surface. When it is assumed that the profile does not change on one of the two sides of the roadway in the longitudinal direction, the incline of the road milling machine gives insight on the condition of the height profile in the longitudinal direction of the roadway on the other side, on which the height profile changes, for example, due to subsidence in the curb region. A large depression in the road surface may, for example, lead to a greater incline of the machine frame than a smaller depression.

If the road milling machine has a transverse incline sensor that generates a sequence of transverse incline data in accordance with the transverse incline of the machine frame with such a milling depth control, the profile data determining device can obtain the height profile data from the transverse incline data, because the transverse incline data with such milling depth control describes the height profile.

To detect the milling depth, tactile sensors may be used, for example, string potentiometers or non-touch sensors, for example ultrasonic sensors. Thus, for example, a string potentiometer can detect the position of the left and/or right edge protector, which lies floating on the road surface, relative to the machine frame. If the milling depth is increased, the edge protector moves upwards—by an amount that corresponds to the change in milling depth—relative to the machine frame. If the milling depth is decreased, in turn, the edge protector moves downwards—by an amount that corresponds to the change in milling depth—relative to the machine frame.

If the milling drum moves over a depression in the road surface, the edge protector is displaced downwards, implying a decrease in the milling depth relative to the road surface. If, meanwhile, the road surface has elevations, then the edge protector is displaced upwards relative to the machine frame, resulting in an increase in the milling depth. Preferably, a milling depth control is designed so that a certain milling depth is predetermined. If the milling depth sensors detect a deviation of the sensor values (the measured values) from the predetermined values (target values), then the milling depth is corrected. Because milling depth sensors may be provided on both sides of the milling drum, a milling depth (optionally, the same one) may be predetermined for each side of the milling drum. If a deviation of the sensor value (measured value) from the predetermined value (target value) is determined only on one side, for example on the left side of the milling drum, then the height of the machine frame is adjusted solely on the left side, for example by retracting or extending only the lifting columns on the left side of the machine frame. If a depression in the road surface is present on the left machine side, this is recognized as a decrease in the milling depth by the left milling depth sensor. In response thereto, the lifting columns on the left side of the machine frame are retracted, in order to increase the milling depth again.

An alternative embodiment proposes that the milling machine comprises a milling depth control device that is for controlling the lifting columns and comprises a first measurement device for measuring the distance of a reference point on the road milling machine to the surface of the unprocessed ground on one of the two sides of the milling drum, wherein the milling depth control device is configured so that the lifting columns are controlled such that when the road milling machine advances, the milling depth on one of the two sides of the milling drum is kept substantially constant, regardless of the condition of the ground surface. A transverse incline control device is then provided that is configured so that the lifting columns are controlled such that the transverse incline of the machine frame when the road milling machine advances is kept substantially constant, regardless of the condition of the ground surface, so that a certain profile with a certain transverse incline can be predetermined for the road surface. If a measurement device for measuring the distance of a reference point on the road milling machine to the surface of the unprocessed ground is provided on the other of the two sides of the milling drum, the height profile data can be obtained from the sequence of the measured distance values. In this embodiment, the profile data determining device is configured so that the height profile data is obtained from the distance data.

The above-described milling depth controls, representing a condition for determining the height profile data from the transverse incline data or distance data, are known in the art. These milling depth controls are described in detail in, for example, DE 10 2006 020 293 A.

BRIEF DESCRIPTION OF THE SEVERAL VIEWS OF THE DRAWINGS

In the following, an embodiment of the invention will be described in detail with reference to the drawings, in which.

DETAILED DESCRIPTION

Figure 1:
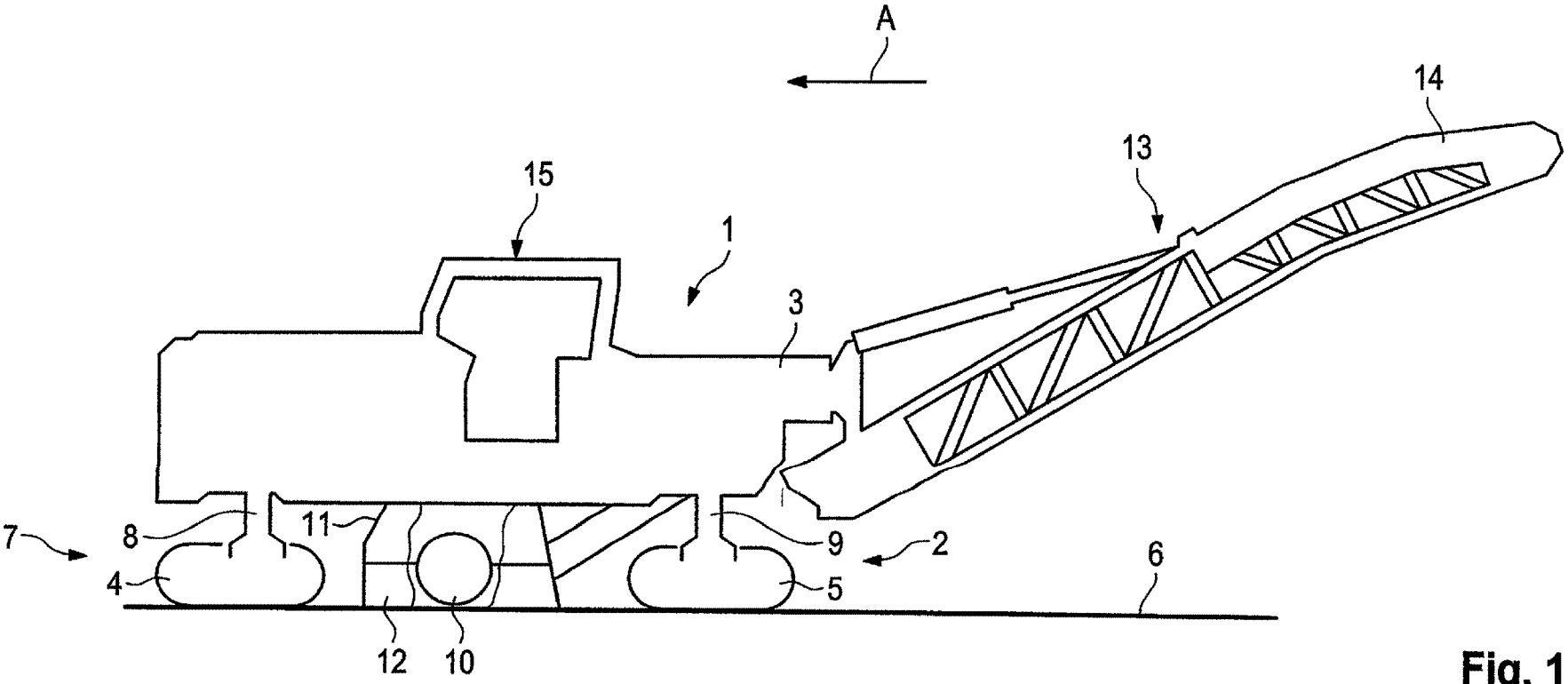
FIG. 1 is a side view of a road milling machine in a simplified representation.

FIG. 1 is a side view of a self-propelled road milling machine for milling off road surfaces, in a simplified representation. The road milling machine 1 comprises a machine frame 3 which is supported by a chassis 2. The chassis 2 of the milling machine comprises front and rear crawler tracks 4 and 5, which are arranged on the right and left sides of the machine frame 3 when viewed in the working direction A. Instead of crawler tracks, it is also possible to provide wheels.

To adjust the height and/or incline of the machine frame 3 relative to the surface of the ground 6, the road milling machine comprises a lifting device 7 that comprises lifting columns 8 and 9 associated with the individual crawler tracks 4, 5 by which the machine frame 3 is supported.

The road milling machine 1 also has a milling drum 10 that is equipped with milling tools 10 and is arranged on the machine frame 3 between the front and rear crawler tracks 4, 5 in a milling drum housing 11 that is closed at the longitudinal faces of a left and right edge protector 12. To remove the milled-off road surface, a conveying device 13 with a conveyor belt 14 is provided. The conveying device 13 is arranged on the rear end of the road milling machine as seen in the working direction A, so that the milled-off material can be loaded from the advancing road milling machine onto a following road finisher. The driver's platform 15 for the machine driver is located on the machine frame 3, above the milling drum housing 11.

Retracting and extending the lifting columns 8, 9 of the lifting device 7 makes it possible to adjust the height and incline of the machine frame 3 and of the milling drum 10 arranged on the machine frame with respect to the surface 6 of the ground. It is, however, generally also possible to change the height and incline of the milling drum with respect to the fixed machine frame.

Figure 2:
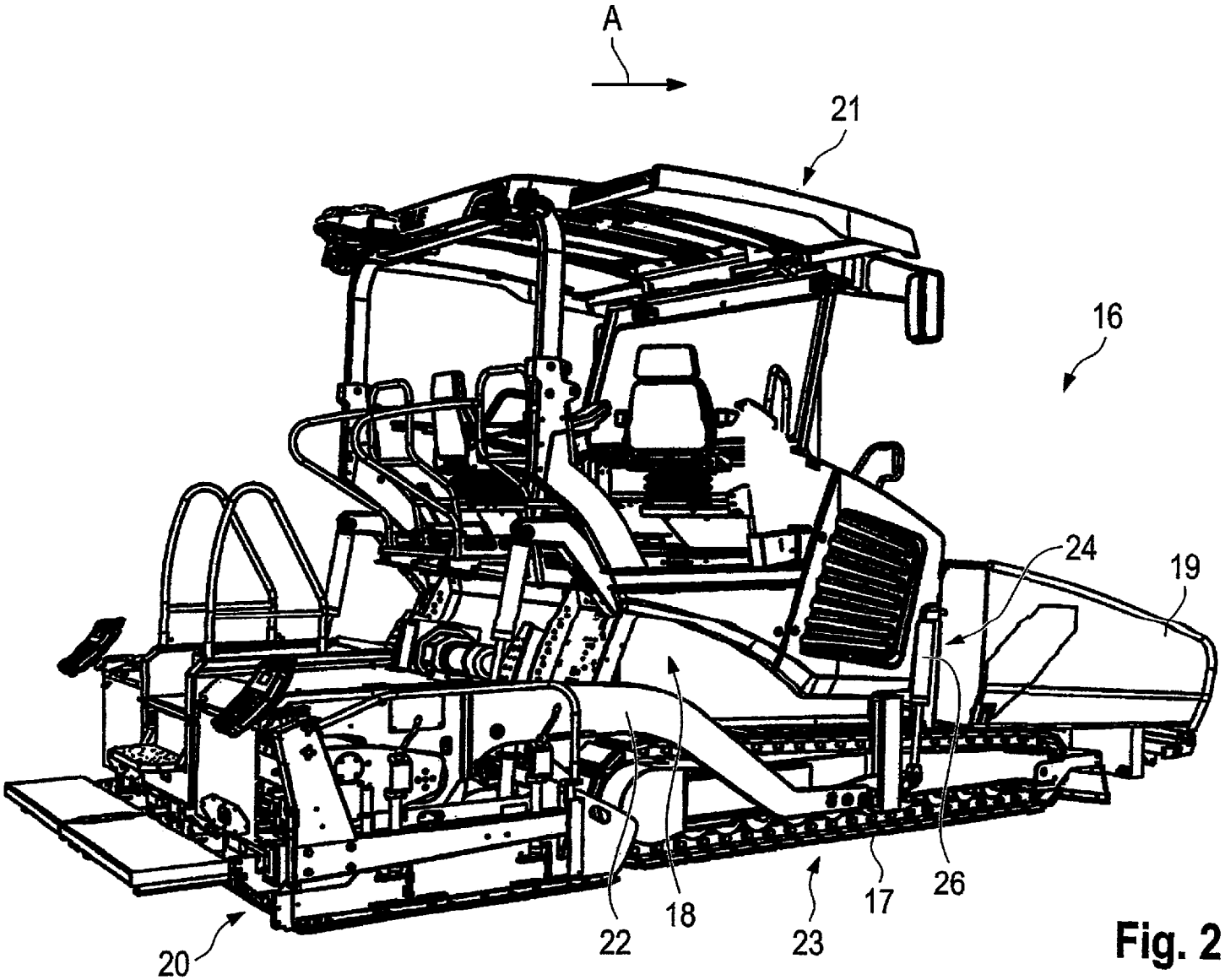
FIG. 2 is a simplified perspective representation of a road finisher.

FIG. 2 is a simplified perspective representation of a self-propelled road finisher 16. The road finisher comprises a machine frame 18 supported by crawler tracks 17 (tracked finisher). Instead of crawler tracks, it is also possible to provide wheels (wheeled finisher). In a front region of the machine frame 18 as seen in the working direction A, a reservoir 19 for holding the material to be laid is arranged. Located at the rear of the road finisher 16 is a screed 20 for laying the material. The driver's platform 21 is arranged between the reservoir 19 and the screed 20.

The screed 20 is configured as a board floating on the material to be laid. For this purpose, the screed 20 is connected to the machine frame 18 so as to be able to move over bars 22 that are provided on both sides of the machine frame 18.

The road finisher 16 has a levelling device 23 (FIG. 3) for levelling off short and elongated uneven areas on the ground so that a roadway of the desired evenness and thickness can be finished. The levelling device 23 has actuators 24 for changing the position of the screed 20, and a controller 23A (FIG. 3) that generates control signals for controlling the actuators 24.

The desired thickness is achieved, in particular, via adjustment of the setting angle of the screed 20, which is determined by the height of a screed traction point. To adjust the screed traction point, the actuators 24 of the levelling device 23 comprise levelling cylinders 26 provided on the sides of the machine frame 18. With the levelling cylinders 26, not only the setting angle of the screed 20 but also the incline of the board can be set transversely to the direction of finishing A.

The controller 23A of the levelling device 23 is configured so that the position of the screed 20 is adjusted on the basis of a height profile data set that comprises a sequence of height profile data describing the height of the road surface 6 in the longitudinal direction.

The road milling machine 1 of FIG. 1 and the road finisher 16 of FIG. 2 are operated according to the invention as a machine train, wherein the road milling machine 1, which travels in front, delivers the height profile data from which the height profile data set for the levelling device 23 of the road finisher 16 that travels behind is obtained.

Figure 3:
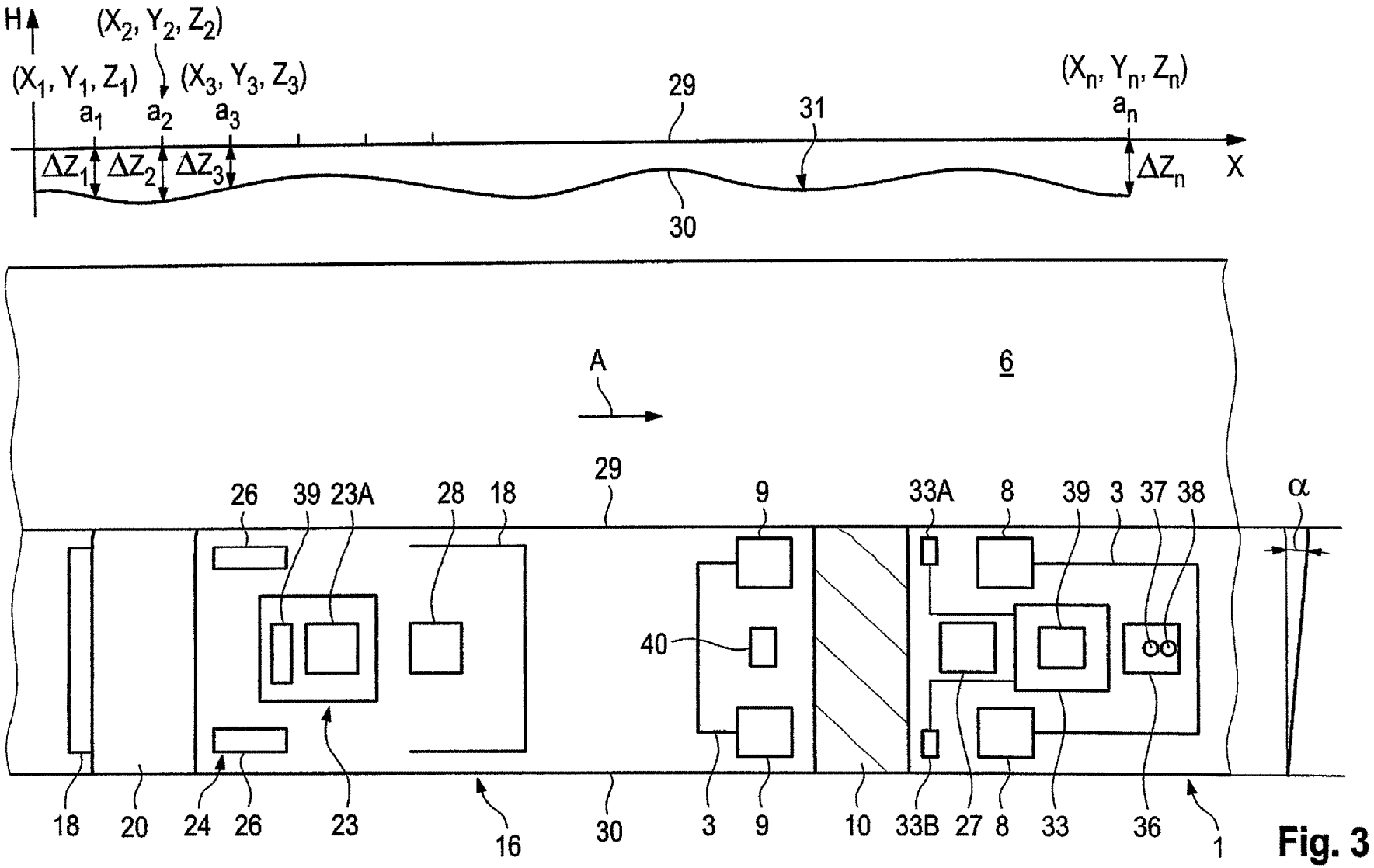
FIG. 3 is a highly simplified, schematic representation of the machine train composed of the road milling machine and road finisher, with the components that are essential for detecting and transmitting the height profile data.

There follows a detailed description, with reference to FIG. 3, of how the height profile data is obtained by the road milling machine 1 and how the height profile data set is obtained from the height profile data. FIG. 3 is a highly simplified, schematic representation of the machine train composed of the road milling machine 1 and the road finisher 16, with the components that are essential for detecting and transmitting the height profile data.

The height profile data is transmitted from the road milling machine 1 to the road finisher 16. The road milling machine 1 comprises a data transmission device 27 for transmitting the height profile data, and the road finisher 16 comprises a data receiving device 28 for receiving the height profile data. The data transmission device and the data receiving device may be a transmitting and receiving device 27, 28. In the present embodiment, the transmitting device 27 is a radio transmitter, and the receiving device 28 is a radio receiver, so that the signals can be transmitted wirelessly. The radio transmitter and radio receiver may be part of a WLAN.

In the present embodiment, the road surface of a damaged road is being milled off with the road milling machine 1, and the milled-off and reconditioned material is being laid back with the road finisher 16 as a new surface.

The road milling machine 1 moves at a predetermined speed of advance, for example on the right half of the road, wherein the milling drum 10 extends transversely to the working direction A across the width of the right half of the road.

FIG. 3 shows the original profile in the middle of the road (middle gradient) and in the region of the right shoulder of the road (outer gradient). The middle gradient 29 exhibits substantially no depressions or elevations. The outer gradient 30, however, has clearly visible depressions 31 and elevations. The height of the road along a line in the longitudinal direction of the road, i.e., the middle or outer gradient, is plotted on the Y-axis, and the distance covered is plotted on the X-axis. $\Delta zn$ designates the vertical distance between the middle gradient 29 and the outer gradient 30 at a point an on the distance covered; for example $\Delta z1$ designates the vertical distance between the middle gradient 29 and the outer gradient 30 at the waypoint a1. The road is inclined towards the edge by the angle $\alpha$. The angle $\alpha$ is here dependent on the horizontal distance and vertical distance $\Delta zn$ between the middle gradient 29 and the outer gradient 30. Because the horizontal distance between the middle gradient 29 and the outer gradient 30 is known, and remains constant over the course of the ground machining, the angle $\alpha$ at the waypoint an is suitable for determining the vertical distance $\Delta zn$.

The milling machine comprises a milling depth control device 33 that is for controlling the lifting columns 8, 9 and comprises a first measurement device 33A for measuring the distance of a reference point on the road milling machine 1 to the surface of the unprocessed ground on the left side of the milling drum 10 as seen in the working direction A, and/or a second measurement device 33B for measuring the distance of a reference point on the road milling machine to the surface of the unprocessed ground on the right side of the milling drum 10 as seen in the working direction A.

To detect the height profile, the road milling machine 1 according to the invention with the milling depth control device 33 is preferably operated so that the road surface processed with the milling drum 10 constitutes a copy of the unprocessed surface, i.e. that largely the same layer thickness is always removed in the longitudinal direction over the entire width of the milling drum. For this purpose, the current milling depth is detected by the two measurement devices 33A, 33B on the right or left side of the milling drum 10. If one of the milling depth measurement devices 33A, 33B confirms a deviating milling depth, a corresponding correction takes place. For example, a depression, if present in the edge region of the road, is levelled off by an increase in the milling depth on this side of the machine frame 3, through retraction of the lifting columns 8, 9—for example piston-cylinder assemblies—on this side. If, on the other hand, there is an elevation present in the edge region, then the milling depth is reduced by extension of the lifting columns on this side of the machine frame. If it is assumed that the middle of the road is largely free of bumps in the ground, it follows that scarcely any regulatory control by the milling depth control will be needed on the side of the machine frame that is aligned to the middle of the road. Experience has shown, however, that the edge region of a road requiring repair often has uneven areas (due to subsidence in the curb area, uneven loads, etc.), so that often regulatory controls are needed on the machine side facing the edge region.

Due to the regulatory control by the milling depth control device 33, the transverse incline of the machine frame 3 changes when the milling machine advances. The changing transverse incline may thus be taken as a measure of the depth of the depression in relation to an average height of the road surface, in particular the middle gradient, i.e. the transverse incline of the machine frame describes the height profile of the road surface at the edge of the roadway.

To measure the distance $\Delta x$ between a reference point on the road milling machine and the unprocessed road surface, the first or second measurement device 33A, 33B may have a distance sensor, which may be a tactile or non-touch distance sensor. For example, the distance sensor may be an ultrasonic sensor. The distance sensor may also be a sensor that detects the position of the left/right edge protector 12 of the milling machine, for example a string potentiometer. The two measurement devices 33A, 33B generate a measurement signal that correlates to the distance received by the milling depth control device 33 of the road milling machine 1. The milling depth control device 33 is configured so that the lifting columns 8, 9 are extended or retracted in accordance with measurement signals in such a manner that when the road milling machine advances, the milling depth is kept substantially constant on the left and right sides of the milling drum 10 as seen in the working direction, regardless of the condition of the road surface. Such a milling depth control device is known from DE 10 2006 020 293 A1.

The road milling machine 1 also has a profile data determining device 36 that comprises a transverse incline sensor 37. The transverse incline a of the machine frame 3 or the milling drum 10, which changes according to bumps in the ground, is acquired by the transverse incline sensor 37 while the road milling machine advances. The transverse incline may be measured continuously during the forward movement, or in predetermined time intervals, in order to generate the height profile data. The height profile data may be, for example, data of the transverse incline sensor 37 that has been read out at regular time intervals by the profile data determining device. From the data of the transverse incline sensor 37, the profile data determining device 36 determines—while the milling machine advances—a sequence of height profile data ($\Delta z1$, $\Delta z2$, $\Delta z3$, . . . , $\Delta zn$) describing the height of the profile at the waypoints a1, a2, a3 . . . an. If a road milling machine already has this milling depth control device, additional components for determining the height profile data are not needed.

The profile data determining device 36 may have a global positioning system (GPS) 38 that provides position data (x1, y1), (x2, y2), (x3, y3) . . . (xn, yn) at the points in time at which the data of the transverse incline sensor 37 is read out, i.e. at the waypoints a1, a2, a3 . . . , an, in order to determine spatial height profile data from the height profile data ($\Delta z1$, $\Delta z2$, $\Delta z3$, . . . , $\Delta zn$). The profile data determining device 36, which determines a sequence of height profile data ($\Delta z1$, $\Delta z2$, $\Delta z3$, . . . , $\Delta zn$) describing the height of the profile at the waypoints a1, a2, a3 . . . an while the milling machine advances, assigns the data (x1, y1), (x2, y2), (x3, y3) . . . (xn, yn) obtained with the GPS system to the height profile data at the individual waypoints. For determining the position data (x1, y1), (x2, y2), (x3, y3) . . . (xn, yn), however, another odometer may also be provided. The position data may also be calculated from the rate of advance and the time that is required by the road milling machine 1 in order to reach a certain waypoint a1, a2, a3 . . . an.

The spatial height profile data Δzn(xn, yn) is used to obtain a spatial height profile data set [Data: (Δz1(x1, y1), Δz2(x2, y2), Δz3(x3, y3) . . . Δzn(xn, yn)] that describes the relative height profile, in the longitudinal direction, of a particular road section, in particular, along the outer gradient.

It is, however, also possible to determine an absolute height profile.

In this case, the absolute height of the middle gradient 29 is determined. If the absolute height of the middle gradient 29 is known, the relative height profile data (Δz1, Δz2, Δz3, . . . , Δzn) can be used to calculate absolute height profile data (z1, z2, z3, . . . , zn) and a spatial absolute height profile data set that describes the absolute height profile in the longitudinal direction of a certain road section, in particular, along the outer gradient.

An assessment device 39, which may be provided in the road milling machine 1 or the road finisher 16, is provided in order to obtain the height profile data set. If the assessment device 39 is provided in the road milling machine 1, the entire data set or a part of the data set is transmitted to the data receiving device 28 with the data transmission device 27. Preferably, the assessment device 39 is provided in the road milling machine 1. The assessment device 39 may then be a component of the milling depth control device 33 of the road milling machine 1.

The assessment device 39 may be configured so that the height profile data is assessed according to known statistical assessment methods. In the present embodiment, the average value can be formed from the measured transverse inclines. It may furthermore be provided in the embodiment that any data lying outside predetermined boundary ranges is discarded before the average value is taken. For these measurement values, it is assumed that incorrect measurements occur, or that the measurement device has not detected the road surface but rather objects—for example, relatively large stones—lying on the road.

In the road finisher 16, the height profile data set may be used to control the actuators 24 of the levelling device 23 of the road finisher 16. The controller 23A of the levelling device 23 may, for example, be configured so that the levelling cylinders 26 are retracted or extended on the basis of the height profile data set. For example, the setting angle and/or the transverse incline of the screed 20 can be adjusted in accordance with the height profile data. In the present embodiment, the transverse incline of the screed 20 changes in accordance with the height profile in such a manner that the depressions on the right side of the road are levelled off. If there is a depression, for example, the incline of the screed 20 is reduced such that a greater amount of material is laid on the right side. With a suitable assessment algorithm, uneven areas on the ground can thus be levelled off.

Alternatively, the necessary changes to the setting angle and/or the transverse incline of the screed 20 may already be determined by the assessment device 39 on the basis of the height profile data set. If the assessment device 39 is provided on the road milling machine 1, it suffices in this instance if only control instructions for the actuators, rather than the entire height profile data set, are transmitted by the data transmission device 27, in particular, to a data receiving device 28.

It is an advantage that the height profile data set determined with the road milling machine 1 travelling in front may comprise data about a relatively large section of the road, without the need to have a large number of sensors in order to determine this data. There is also no need for a jib on the road finisher 16 in order to fasten a plurality of sensors, which would moreover be substantially limited in terms of spatial dimensions to the length of the finisher. Even the gradients of winding roads can easily be acquired and made available to the road finisher.

The milling depth control device 33 of the road milling machine 1 and the levelling device 23 of the road finisher 16 may have, for example, a general processor, a digital signal processor (DSP) for continuously processing digital signals, a microprocessor, an application-specific integrated circuit (ASIC), an integrated circuit composed of logic elements (a field-programmable gate array (FPGA)), or another integrated circuit (IC) or hardware components, in order to control the actuators. A data processing program (software) can run on the hardware components. A combination of the different components is also possible.

An alternative embodiment proposes a milling depth control device that is known in the art, is for controlling the lifting columns 8, 9, and comprises a first measurement device for measuring the distance of a reference point on the road milling machine to the surface of the unprocessed ground on only one of the two sides of the milling drum 10. In the present embodiment, a measurement device 33A is provided only on the left side of the machine frame 3. The milling depth control device 33 is configured so that the lifting columns 8, 9 are extended or retracted in such a manner that when the road milling machine advances, the milling depth on the one of the two sides of the milling drum is kept substantially constant, regardless of the condition of the ground surface. In the present embodiment, the milling depth is kept constant on the left side. A transverse incline control device 40 is also provided that is configured so that the lifting columns 8, 9 are controlled such that the transverse incline of the machine frame 3 when the road milling machine advances is kept substantially constant, regardless of the condition of the ground surface, so that a predetermined transverse incline is produced for the milled-off surface. A result thereof, however, is that the same layer thickness is not always removed on the right side in the longitudinal direction, for example only a slight layer thickness in the region of a depression and a greater layer thickness than the average layer thickness in the region of an elevation. The transverse incline control device may be a component of the milling depth control device, which, in turn, may be a component of a central control and processing unit. The milling depth control device (or the central control and processing unit having the milling depth control device as a component thereof) on the road milling machine may be referred to herein as a "first controller" wherein the controller on the road finisher may accordingly be referred to herein as a "second controller," or vice versa.

With a second measurement device 33B for measuring the distance of a reference point on the road milling machine to the surface of the unprocessed ground on the other of the two sides of the milling drum 10—on the right side in the present embodiment—a sequence of distance data is generated. In this embodiment, the profile data determining device 36 is configured so that the height profile data is obtained from the distance data of the second measurement device 33B. Such a milling depth control device having two measurement devices on the left and right sides and a transverse incline control for adjusting a certain transverse incline is known from DE 10 2006 020 293 A1.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A machine train comprising:

a road milling machine comprising a first machine frame supported by a first set of crawler tracks or wheels and a milling drum arranged on the first machine frame and configured to mill away material from a road surface, wherein the first set of crawler tracks or wheels of the road milling machine are fastened via lifting columns to the first machine frame;

a road finisher that travels behind the road milling machine in a traveling direction and comprises a second machine frame which is supported by a second set of crawler tracks or wheels and on which are arranged a reservoir for material to be laid and a screed for laying material, wherein a position of the screed is adjustable in relation to a reference line or reference surface;

at least a first sensor and at least a second sensor positioned on respective first and second sides of the milling drum as seen in a working direction, wherein one of the first sensor and second sensor is configured to measure a distance of a reference point on the road milling machine to a surface on its respective side of the milling drum, and wherein the other one of the first sensor and second sensor is configured to generate a sequence of distance data on its respective side of the milling drum;

a transverse incline sensor positioned in association with the road milling machine and configured to measure a transverse incline of the first machine frame;

a controller for the road milling machine, configured to generate height profile data based on the sequence of distance data from the other one of the first and second sensor, and control the lifting columns such that when the road milling machine advances, the milling depth on the respective side of the one of the first sensor and the second sensor and the measured transverse incline of the first machine frame when the road milling machine advances are kept substantially constant, regardless of the condition of the ground surface, wherein the distance data from the other one of the first and second sensor changes with movement of the road milling machine in a manner corresponding to a profile of unprocessed road surface, and wherein the generated height profile data accordingly changes with movement of the road milling machine in a manner corresponding to the profile of the unprocessed road surface; and a data transmission device configured to transmit the height profile data to the road finisher.

2. The machine train of claim 1, wherein the road finisher further comprises a data receiving device configured to receive the height profile data.

3. The machine train of claim 1, wherein the road finisher comprises at least one actuator for changing the position of the screed, and a second controller that is configured to generate a control signal for controlling the at least one actuator in accordance with a height profile data set obtained from the height profile data.

4. The machine train of claim 3, wherein the at least one actuator is controlled to change the position of the screed in accordance with the height profile data to level off uneven areas in the profile of the road surface.

5. The machine train of claim 3, wherein the second controller is configured to assess the height profile data statistically in order to obtain the height profile data set.

6. The machine train of claim 5, wherein the second controller is configured so that assessing the height profile data statistically comprises one or more of taking an average value and discarding height profile data lying outside predetermined boundary ranges.

7. The machine train of claim 3, wherein the first controller is configured to assess the height profile data statistically in order to obtain the height profile data set.

8. The machine train of claim 3, wherein the road milling machine comprises a device for determining spatial data, and the first controller is configured to determine spatial height profile data from the height profile data.

9. A method of operating a road milling machine that travels in front and comprises a first machine frame supported by crawler tracks or wheels and a milling drum arranged on the first machine frame that is for milling away material from a road surface, wherein the crawler tracks or wheels are fastened to the first machine frame via lifting columns, and a road finisher that travels behind and comprises a second machine frame which is supported by crawler tracks or wheels and on which are arranged a reservoir for material to be laid and a screed for laying material, wherein a position of the screed is adjustable in relation to a reference line or reference surface, the method comprising:

measuring a distance of a reference point on the road milling machine to a surface of unprocessed ground on a first side of the milling drum as seen in a working direction;

determining a sequence of distance data in accordance with measured distances of the reference point on the road milling machine to a surface of unprocessed ground on a second side of the milling drum as seen in a working direction;

measuring transverse inclines of the first machine frame while the road milling machine advances;

generating height profile data based on the sequence of distance data;

controlling the lifting columns such that when the road milling machine advances, a milling depth on the first side of the milling drum as seen in the working direction and a transverse incline of the first machine frame are controlled to respective target values, regardless of a ground surface condition, wherein the measured distances of the reference point on the road milling machine to the surface of unprocessed ground on the second side of the milling drum change with movement of the road milling machine in a manner corresponding to a profile of unprocessed road surface, and wherein the height profile data accordingly changes with movement of the road milling machine in a manner corresponding to the profile of the unprocessed road surface; and transmitting the height profile data with a data transmission device to the road finisher.

10. The method of claim 9, further comprising receiving the height profile data by a data receiving device of the road finisher.

11. The method of claim 10, further comprising controlling at least one actuator on the road finisher in order to change the position of the screed in accordance with a height profile data set obtained from the height profile data.

12. The method of claim 11, comprising statistically assessing the height profile data in order to obtain the height profile data set, wherein the statistical assessment of the height profile data comprises taking an average value and/or discarding height profile data lying outside predetermined boundary ranges.

13. The method of claim 9, further comprising obtaining spatial height profile data from the height profile data.

14. The method of claim 9, wherein the screed of the road finisher is controlled in accordance with the height profile data to level off uneven areas in the profile of the road surface.

15. A machine train comprising:

a road milling machine for milling away material from a road surface, comprising:

a first machine frame supported by a first set of tracks or wheels, a milling drum arranged on the first machine frame, wherein the first set of tracks or wheels are fastened via lifting columns to the first machine frame, a first sensor configured to measure a distance of a reference point on the road milling machine to a surface of unprocessed ground on a first side of the milling drum as seen in a working direction as the road milling machine advances, a second sensor configured to generate signals corresponding to a sequence of distance data in accordance with distances of the reference point on the road milling machine to a surface of unprocessed ground on a second side of the milling drum as seen in the working direction, and a transverse incline sensor configured to measure transverse inclines of the first machine frame while the road milling machine advances; and a road finisher for laying new material on the milled road surface, comprising:

a second machine frame which is supported by a second set of tracks or wheels, a reservoir on the second machine frame for material to be laid, a screed for laying material, at least one actuator for changing the position of the screed, and a controller configured to generate a control signal for controlling the at least one actuator and change the position of the screed in relation to a reference line or reference surface, based at least in part on height profile data obtained from the sequence of distance data and which accordingly changes with movement of the road milling machine in a manner corresponding to the profile of the unprocessed road surface, wherein the screed is controlled in accordance with the height profile data to level off uneven areas in the profile of the unprocessed road surface.

16. The machine train of claim 15, wherein the controller is configured to assess the height profile data statistically by one or more of taking an average value and discarding height profile data lying outside predetermined boundary ranges..

17. The machine train of claim 15, wherein the controller is configured to determine spatial height profile data from the height profile data.

* * * * *